US010808307B2

(12) United States Patent
Kim et al.

(10) Patent No.: US 10,808,307 B2
(45) Date of Patent: Oct. 20, 2020

(54) CHROMIUM-ALUMINUM BINARY ALLOY HAVING EXCELLENT CORROSION RESISTANCE AND METHOD OF MANUFACTURING THEREOF

(71) Applicant: Korea Atomic Energy Research Institute, Daejeon (KR)

(72) Inventors: Hyun Gil Kim, Daejeon (KR); Il Hyun Kim, Daejeon (KR); Yang-Il Jung, Daejeon (KR); Dong Jun Park, Daejeon (KR); Jung Hwan Park, Daejeon (KR); Jeong-Yong Park, Daejeon (KR); Yang-Hyun Koo, Daejeon (KR)

(73) Assignee: Korea Atomic Energy Research Institute, Daejeon (KR)

( * ) Notice: Subject to any disclaimer, the term of this patent is extended or adjusted under 35 U.S.C. 154(b) by 268 days.

(21) Appl. No.: 15/610,533

(22) Filed: May 31, 2017

(65) Prior Publication Data

US 2017/0260613 A1 Sep. 14, 2017

Related U.S. Application Data

(63) Continuation-in-part of application No. 14/695,792, filed on Apr. 24, 2015.

(30) Foreign Application Priority Data

Oct. 20, 2014 (KR) ..... 10-2014-0141522

(51) Int. Cl.
*C22F 1/11* (2006.01)
*C22C 1/02* (2006.01)
(Continued)

(52) U.S. Cl.
CPC ..... *C22F 1/11* (2013.01); *C22C 1/02* (2013.01); *C22C 27/06* (2013.01); *C23C 4/08* (2013.01); *C22C 16/00* (2013.01); *C22C 19/03* (2013.01)

(58) Field of Classification Search
CPC ..... C22C 1/02; C22C 27/06; C22F 1/11
(Continued)

(56) References Cited

U.S. PATENT DOCUMENTS 2,809,139 A * 10/1957 Bloom ..... C22C 27/06 148/668
3,955,935 A * 5/1976 Shockley ..... B23P 15/04 204/490

FOREIGN PATENT DOCUMENTS

JP 1991-211248 9/1991
JP H03211248 * 9/1991
(Continued)

OTHER PUBLICATIONS

Helander et al., "An experimental investigation of possible b2-ordering in the al-cr system." 1998. Journal of Phase equilibria. 20. (1). p. 57-60 (Year: 1998).*
(Continued)

*Primary Examiner* — Colleen P Dunn
*Assistant Examiner* — Nicholas A Wang
(74) *Attorney, Agent, or Firm* — Leydig, Voit & Mayer, Ltd.

(57) ABSTRACT

The present disclosure relates to a chromium-aluminum binary alloy with excellent corrosion resistance and a method of producing the same, and more particularly to a chromium-aluminum binary alloy with excellent corrosion resistance. The chromium-aluminum binary alloy may be easily produced and has ductility, thus being highly applicable as a coating material for a material requiring high-temperature corrosion resistance and wear resistance.

7 Claims, 7 Drawing Sheets

(51) Int. Cl.

| | |
|---|---|
| ***C22C 27/06*** | (2006.01) |
| ***C23C 4/08*** | (2016.01) |
| *C22C 16/00* | (2006.01) |
| *C22C 19/03* | (2006.01) |

(58) Field of Classification Search
USPC ..... 420/428
See application file for complete search history.

(56) References Cited

FOREIGN PATENT DOCUMENTS

| | | |
|---|---|---|
| JP | H05271840 | * 10/1993 |
| JP | 2005-154836 | 6/2005 |
| KR | 10-2002-0082477 | 10/2002 |
| RU | 94037777 | 9/1996 |

OTHER PUBLICATIONS

Al (Aluminum) Binary Alloy Phase Diagrams, Alloy Phase Diagrams. vol. 3, ASM Handbook, ASM International, 2016, p. 113-139. (Year: 2016).*

American Society for Metals, "Binary Alloy Phase Diagrams", vol. 1, (1986), Editor: Thaddeus Massalski, p. 104.

Helander et al. (1999) "An Experimental Investigation of Possible b2-Ordering in the Al—Cr System," Journal of Phase Equilibria 20:57-60.

* cited by examiner

Cr-20Al

Point Analysis

Processing option : All elements analyzed (Normalised)

| Spectrum | Al | Cr | Total |
|---|---|---|---|
| S1 | 18.20 | 81.80 | 100.00 |
| S2 | 18.43 | 81.57 | 100.00 |
| S3 | 18.30 | 81.70 | 100.00 |
| Max. | 18.43 | 81.80 | |
| Min. | 18.20 | 81.57 | |

All results in Weight Percent

Cr-30Al

Point Analysis

Processing option : All elements analyzed (Normalised)

| Spectrum | Al | Cr | Total |
|---|---|---|---|
| S1 | 40.61 | 59.39 | 100.00 |
| S2 | 26.46 | 73.54 | 100.00 |
| S3 | 39.46 | 60.54 | 100.00 |
| S4 | 40.60 | 59.40 | 100.00 |
| S5 | 25.96 | 74.04 | 100.00 |
| S6 | 37.48 | 62.52 | 100.00 |
| Max. | 40.61 | 74.04 | |
| Min. | 25.96 | 59.39 | |

All results in Weight Percent

CHROMIUM-ALUMINUM BINARY ALLOY HAVING EXCELLENT CORROSION RESISTANCE AND METHOD OF MANUFACTURING THEREOF

CROSS-REFERENCES TO RELATED APPLICATION

This patent application is a Continuation in Part of application Ser. No. 14/695,792, filed on Apr. 24, 2015, and claims the benefit of priority from Korean Patent Application No. 10-2014-0141522, filed on Oct. 20, 2014, the contents of each are incorporated herein by reference.

BACKGROUND OF THE INVENTION

1. Field of the Invention

The present disclosure relates to a chromium-aluminum binary alloy with excellent corrosion resistance and a method of producing the same, and more particularly, to a chromium-aluminum binary alloy including 1 to 40% (6 to 25%) by weight of aluminum and to a method of producing the same.

2. Description of the Related Art

A zirconium alloy material used as a core component of a fuel assembly in Japan's Fukushima accident generated a large amount of hydrogen by a very high corrosion reaction rate to act as the cause of a hydrogen explosion in a high-temperature oxidizing atmosphere in which coolant was lost and a temperature of a nuclear fuel was increased.

From this fact, it was confirmed that when the current zirconium alloy material was used as a core material of a nuclear power plant, there was no big problem in a steady-state, but safety was not guaranteed in an accident-state.

One of ways to overcome the limitation of the zirconium alloy at a high-temperature accident-state and to greatly enhance safety of the fuel assembly is to replace the zirconium alloy with a material having an excellent oxidation resistance or to coat a zirconium alloy surface with an oxidation-resistant material to increase oxidation resistance.

That is, when a material in which oxidation is hardly generated is applied to the zirconium alloy or an oxidation-resistant coating material stable at a high-temperature environment of an accident-state is present on a zirconium alloy surface, an oxidation reaction is significantly suppressed to reduce hydrogen generation by the oxidation reaction, so that a risk of hydrogen explosion may be blocked.

To solve this problem, in laboratories and academia worldwide, research for developing a $SiC/SiC_f$ material, a FeCrAl alloy, a Zr—Mo-coated cladding tube, a Zr-coated cladding tube or the like with a new material has been in progress to improve safety of a nuclear power plant in an environment such as the Fukushima accident.

However, these material technologies are favorable in a normal-state but unfavorable in an accident-state, and vise versa. For example, a $SiC/SiC_f$ material is being evaluated to have excellent high-temperature strength and superior oxidation resistance, but to have drawbacks in that the material dissolution very quickly in a steady-state ambient and the production cost is very high.

The FeCrAl alloy has excellent corrosion resistance under steady and accident-states, but, due to a material characteristic, has a large neutron absorption cross-sectional area and a low tritium collection property, thus having a disadvantage in that the FeCrAl alloy is economically infeasible when being used in a steady operation.

The Zr—Mo-coated cladding tube is excellent in high temperature strength, but greatly increases a cost for producing the cladding as a trilayer and still has a lot of problems to be technically solved.

The Zr-coated cladding tube has an advantage of accelerating a development cycle with a relatively low cost compared to other technologies, but has a problem of a low coating effect due to a peeling problem of a coating layer and a reaction of a coating material with a Zr-base material at a high temperature.

That is, when the FeCrAl alloy with excellent corrosion resistance is applied to the Zr-coated cladding tube, there are problems in which a composition of the coating material is changed by interdiffusion of Zr and Fe at a temperature of 950° C. or higher and a base material of the Zr cladding tube form a Zr—Fe-based intermetallic compound to be weakened.

When a pure Cr layer is applied to the base material of the Zr cladding layer, interdiffusion between Cr and Zr may take place at 1400° C. or higher to reduce a problem due to a microstructure change. However, the Zr-coated cladding tube is weak to an impact due to low ductility of the Cr layer and has a relatively low high-temperature oxidation resistance compared to the FeCrAl alloy. If Zr is coated with pure Cr, the high-temperature oxidation resistance in an accident environment would be excellent but when exposed for a long time under normal operating conditions, pitting corrosion would be occurred and later peeled off.

Meanwhile, as a related art regarding high a corrosion resistance alloy, Korea Patent Registration No. 10-0584113 discloses an FeCrAl material and a method of producing the same. Specifically, as a method of producing an FeCrAl material by gas atomization, the related art provides a method of producing an FeCrAl material, the method being characterized in that the FeCrAl material contains: iron (Fe), chromium (Cr), and aluminum (Al) and further includes at least one of molybdenum (Mo), hafnium (Hf), zirconium (Zr), yttrium (Y), nitrogen (N), carbon (C), and oxygen (O); a smelt to be sprayed contains 0.05% to 0.50% by weight of tantalum (Ta) and titanium (Ti) less than 0.10% by weight; and a composition of the smelt is determined such that a composition of a powder obtained after the spraying becomes Fe: balance, Cr: 15-25, Al: 3-7, Mo: <5, Y: 0.05-0.60, Zr: 0.01-0.30, Hf: 0.05-0.50, Ta: 0.05-0.50, Ti: <0.10, C: 0.01-0.05, N: 0.01-0.06, O: 0.02-0.10, Si: 0.10-0.70, Mn: 0.05-0.50, P: <0.8, S: <0.005 [unit of % by weight].

However, since the FeCrAl material, due to a material characteristic thereof, has a large neutron absorption cross-sectional area and a low collection property of tritium generated in a nuclear fuel, the FeCrAl material is economically infeasible used in a steady operation, and has a problem in which a base material of the Zr cladding tube forms a Zr—Fe-based intermetallic compound to be weakened when the FeCrAl material is applied to the Zr cladding tube.

Thus, it is difficult to realize both safety and economic feasibility with a combination of materials and coating technologies reported so far, under a steady-state or an accident-state of nuclear power.

Therefore, while carrying out a research about a material having high corrosion resistance, the material being able to realize both safety and economic feasibility under a steady-state or an accident-state of nuclear power, the present inventors succeeded in developing a chromium-aluminum binary alloy having high hardness and good oxidation resistance.

SUMMARY OF THE INVENTION

One object of the present invention is to provide a chromium-aluminum binary alloy with excellent corrosion resistance.

Another object of the present invention is to provide a method of producing a chromium-aluminum binary alloy with excellent corrosion resistance.

Still another object of the present invention is to provide a high-temperature environment structural material including a chromium-aluminum binary alloy with excellent corrosion resistance.

Even another object of the present invention is to provide a surface coating material of a metal material, the surface coating material including a chromium-aluminum binary alloy with excellent corrosion resistance.

In order to achieve the objects, the present invention provides a chromium-aluminum binary alloy with excellent corrosion resistance, the chromium-aluminum binary alloy including 6 to 30% by weight of aluminum, 6 to 25% by weight of aluminum, 6 to 20% by weight of aluminum or 10 to 20% by weight of aluminum, the balance of chromium (Cr), and other unavoidable impurities with respect to a total weight of the alloy.

The present invention also provides a producing method of a chromium-aluminum binary alloy with excellent corrosion resistance, the producing method including: mixing and melting a raw material including the above-described content of aluminum (Al), the balance of chromium (Cr), and other unavoidable impurities with respect to a total weight of the alloy (Step 1); and solution treating the alloy melted during Step 1 (Step 2).

Furthermore, the present invention provides a chromium-aluminum binary alloy with excellent corrosion resistance, which is produced according to the method and has superior corrosion resistance and high-temperature oxidation resistance to a zircaloy-4 alloy, pure chromium, and a FeCrAl alloy.

Furthermore, the present invention provides a high-temperature environment structural material including the chromium-aluminum binary alloy with excellent corrosion resistance.

Furthermore, the present invention provides a surface coating material of a metal material, the surface coating material including the chromium-aluminum binary alloy with excellent corrosion resistance.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
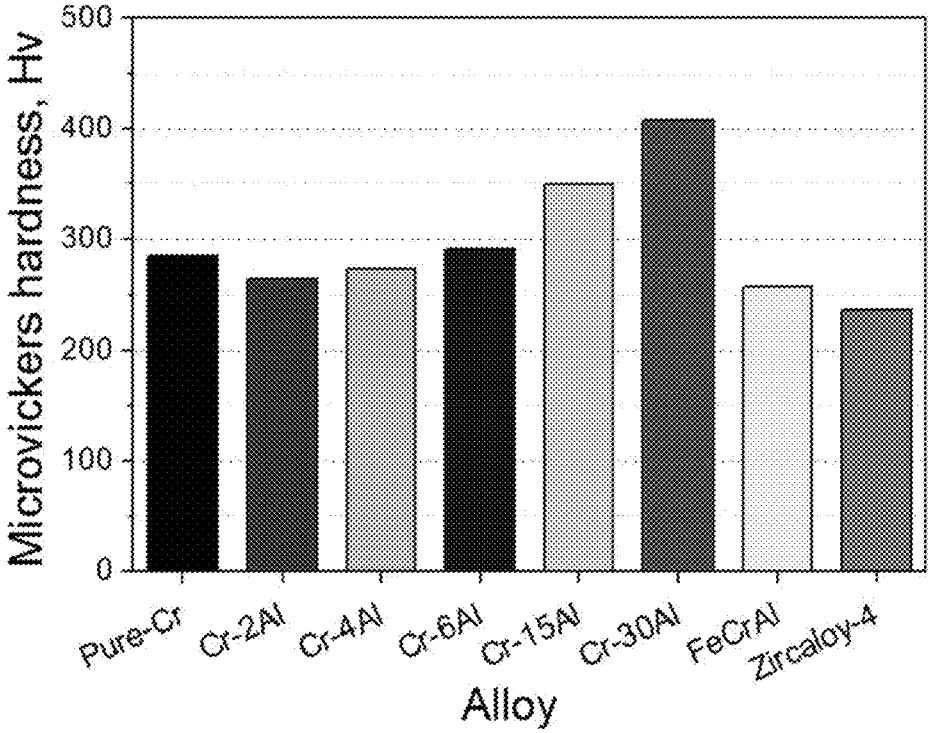
FIG. 1 is a graph showing hardness of a chromium-aluminum binary alloy produced in Examples 2, 3, 4, 6, and 9 and a metal material of Comparative Examples 1 to 3 measured by a micro Vickers hardness tester.

The present invention provides a chromium-aluminum binary alloy with excellent corrosion resistance, the chromium-aluminum binary alloy including 1 to 40% by weight of aluminum, the balance of chromium, and other unavoidable impurities with respect to a total weight of the alloy.

The present invention also provides a chromium-aluminum binary alloy with excellent corrosion resistance, the chromium-aluminum binary alloy including 6 to 30% by weight of aluminum, 6 to 25% by weight of aluminum, 6 to 20% by weight of aluminum or 10 to 20% by weight of aluminum, the balance of chromium, and other unavoidable impurities with respect to a total weight of the alloy.

The present invention also provides a chromium-aluminum binary alloy with excellent corrosion resistance, the chromium-aluminum binary alloy including 10 to 25% by weight of aluminum, 10 to 20% by weight of aluminum or 10 to 18% by weight of aluminum, the balance of chromium, and other unavoidable impurities with respect to a total weight of the alloy.

In this invention, the high temperature is not limited as long as it is in the range of 280~360° C., which is the operating condition of the nuclear power plant or at least 950° C., 1000° C., 1100° C., and 1200° C., which are the temperatures in the case of accident of the nuclear power plant. However, it is preferably up to 2000° C. or 1800° C.

Hereinafter, the chromium-aluminum binary alloy with excellent corrosion resistance according to the present invention will be described in more detail.

Conventionally, in order to improve safety of a nuclear power plant, a $SiC/SiC_f$ material, a FeCrAl alloy, a Zr—Mo-coated cladding tube, a Zr-coated cladding tube and the like have been developed as advanced materials, but have drawbacks as described above. The $SiC/SiC_f$ material is fast melted in a steady-state but its production cost is high and it is highly reactive to the nuclear fuel pellet at a high temperature of at least 1400° C. The FeCrAl alloy has a melting point of 1500° C. or less, lacks high temperature stability, has a high neutron absorption cross-sectional area; and has a low tritium capturing capacity, indicating the alloy has not economic feasibility. The Zr—Mo-coated cladding tube asks high production costs for the three layered structure and is not economically feasible due to the high neutron absorption cross section of Mo. The Zr—FeCrAl cladding tube has problems in which a composition of the coating material is changed by interdiffusion of Zr and Fe at a temperature of 950° C. or higher and a base material of the Zr cladding tube form a Zr—Fe-based intermetallic compound to be weakened. The Zr-pure Cr coated cladding tube is weak to an impact due to low ductility of the Cr layer and has a relatively low high-temperature oxidation resistance compared to the FeCrAl alloy. Also, when pure Cr is coated on Zr, there is a problem that the coating layer peels off due to pitting corrosion of the Cr layer in the normal corrosion environment. Accordingly, combinations of materials and coating technologies reported so far have a difficulty in realizing both safety and economic feasibility in a steady-state and an accident-state of nuclear power.

However, the present invention provides a chromium-aluminum binary alloy in which a content of aluminum is 1 to 40% by weight with respect to a total weight of the alloy.

Cr forms a stable oxide of $Cr_2O_3$ by an oxidation reaction and Al forms a stable oxide $Al_2O_3$ by an oxidation reaction, thus increasing corrosion resistance of the Cr—Al binary alloy. In addition, a proper combination of Cr—Al composition suppresses pitting corrosion caused by pure Cr, and can achieve excellent performance in normal environment corrosion of a reactor. When applied to nuclear power, the chromium-aluminum binary alloy has excellent corrosion resistance in an accident-state as well as a steady-state operation, thus providing effects of being able to significantly increase economic feasibility and accident safety of nuclear power.

If the concentration of aluminum included in the binary alloy is less than or more than the range limit mentioned above, an $Al_8Cr_5$ intermetallic compound is produced so that corrosion resistance would be reduced and corrosion resistance would be comparatively poor. If the concentration of aluminum is more than the upper limit of the above range, the $Al_8Cr_5$ intermetallic compound production would be a problem. Due to the characteristics of the intermetallic compound, the brittleness is very strong, which results in lack of processability and difficulty in controlling the composition. In addition, since a melting point decreases as an added amount of aluminum increases, there is a problem in that it becomes impossible to use the binary alloy at high temperatures, such as a nuclear power plant accident environment.

The aluminum is preferably included in an amount of 6% to 30% by weight, 6% to 25% by weight, 6% to 20% by weight, 10% to 20% by weight, or 10% to 18% by weight.

Within the designated range of Al content, if the concentration of less than the lower limit of the range, dissolution would be observed during corrosion reaction in a steady-state, indicating that the material is hard to be applied as a nuclear power plant material. In the meantime, if the concentration is over the upper limit of the range above, Al is phase-decomposed in Cr—Al during long-time exposure under the normal operating condition of a nuclear power plant, so that the microstructure is formed in a region having a high Al content and a low region, resulting in the reduced corrosion resistance.

In another aspect, the aluminum is preferably included in an amount of 10% to 25% by weight, 10% to 20% by weight, or 10% to 18% by weight.

If the concentration of Al is out of the designated range above, the corrosion resistance is relatively poor under the high temperature operating condition of the nuclear power plant, for example, at the high temperature condition of 1200° C.

The present invention provides a method of producing a chromium-aluminum binary alloy with excellent corrosion resistance, the method including: mixing and melting raw materials including aluminum (Al), the balance of chromium (Cr), and other unavoidable impurities with respect to a total weight of the alloy (Step 1); and solution treating the alloy melted during Step 1 (Step 2).

The content of aluminum is put into the range of weight % within the predetermined range.

Hereinafter, a method of producing a chromium-aluminum binary alloy with excellent corrosion resistance according to the present invention will be described for each step in more detail.

In the method of producing a chromium-aluminum binary alloy with excellent corrosion resistance according to the present invention, Step 1 is a step of mixing and melting raw materials including a proper weight % of aluminum (Al), the balance of chromium (Cr), and other unavoidable impurities with respect to a total weight of the alloy.

In Step 1, the raw materials are mixed and melted in a molten metal bath to produce an alloy in which the raw materials are homogeneously mixed.

Conventionally, in order to improve safety of a nuclear power plant, a $SiC/SiC_f$ material, a FeCrAl alloy, a Zr—Mo-coated cladding tube, a Zr-coated cladding tube and the like have been developed as advanced materials, but have drawbacks as described above. Accordingly, combinations of materials and coating technologies reported so far have a difficulty in realizing both safety and economic feasibility in a steady-state and an accident-state of nuclear power.

However, the present invention provides a chromium-aluminum binary alloy in which an amount of aluminum is 1% to 40% by weight.

Compared to oxide-based ($SiO_2$, $Cr_2O_3$, $Al_2O_3$, $ZrO_2$), carbide-based ($Cr_3C_2$, SiC, ZrC), nitride-based (ZrN) intermetallic compounds, and a MAX phase (C or N-added compound), the chromium-aluminum binary alloy is easy to produce. Also, the ductility of the chromium-aluminum binary alloy not only makes it easy to produce a product but also improves applicability as a coating material. In addition, the chromium-aluminum binary alloy has excellent corrosion resistance to significantly reduce a hydrogen explosion phenomenon caused by an excessive oxidation reaction when used as a component and a coating material of a nuclear power plant.

In another aspect, the aluminum is preferably included in an amount of 10% to 25% by weight, 10% to 20% by weight, or 10% to 18% by weight.

In another aspect, the aluminum is preferably included in an amount of 15% to 20% by weight.

The corrosion resistance is relatively excellent within the predetermined range of the Al content at a high temperature condition of a nuclear power plant, for example, at the high temperature condition of 1200° C.

Meanwhile, the melting in Step 1 may be performed at a temperature of 1400° C. to 1800° C. When the melting of Step 1 is performed less than 1400° C., there may be a problem in which a liquid molten state is not maintained and thus an alloy is not properly formed, and when the melting of Step 1 is performed more than 1800° C., there may be caused problems in which reactivity of molten metal is increased to include a large amount of impurities, and Al having a low melting point is evaporated to have a difficulty in controlling the composition, and costs increase.

In the method of producing a chromium-aluminum binary alloy with excellent corrosion resistance according to the present invention, Step 2 is a step of solution treating the alloy melted during Step 1.

In Step 2, the alloy melted in Step 1 is heated up to a range in which the melted alloy becomes a solid solution, and is quenched to maintain the solid solution state, and through this step, the alloy elements may readily form the solid solution.

The solution treating of Step 2 may be performed at a temperature of 950° C. to 1200 ° C., 1000° C. to 1200 ° C., or 1050° C. to 1200° C. When the temperature is lower than 950° C. in the solution treating of Step 2, there is a problem in which the precipitate $AlCr_2$ is not completely melted and thus a desired property is not obtained, and when the temperature is higher than 1200° C., a production cost is increased so that the solution treating of Step 2 is economically infeasible.

The present invention provides a chromium-aluminum binary alloy with excellent corrosion resistance, which is produced according to the above-described method.

The present invention relates to a chromium-aluminum binary alloy, the binary alloy being able to have excellent mechanical property and corrosion resistance at room temperature as well as at high temperatures. In particular, the chromium-aluminum binary alloy may have hardness of 250 to 450 Hv, and superior high-temperature oxidation resistance to a zircaloy-4 alloy, pure chromium, and a FeCrAl alloy.

The present invention provides a high-temperature environment structural material including the chromium-aluminum binary alloy with excellent corrosion resistance.

Since the chromium-aluminum binary alloy according to the present invention has excellent corrosion resistance even at high temperature as well as at room temperatures, the chromium-aluminum binary alloy may be not only used as a material for components of a nuclear power plant but also be applied to a structural material used in a high temperature environment, such as thermal power generation and an aircraft engine, and a gas turbine.

The present invention provides a surface coating material including the chromium-aluminum binary alloy with excellent corrosion resistance.

According to the present invention, since the chromium-aluminum binary alloy has superior corrosion resistance, is easy to produce, and has ductility, the chromium-aluminum binary alloy may be applied as a coating material. In addition, when the alloy of the present invention is used as a coating material, the second phase must not be formed even after being coated.

The chromium-aluminum binary alloy may be utilized as a zirconium coating material used in a nuclear power plant, and as a coating material of a metal structural material used at a high temperature in addition to the nuclear power plant.

In the case, the metal material may be stainless steel or inconel and has advantages of reducing a cost and a term for technology development compared to an advanced anti-oxidation material, by coating the alloy of the present invention on such a metal material.

Hereinafter, the present invention will be described below in detail with reference to the following examples. However, the following examples are provided for illustrative purposes only, and the scope of the present invention should not be limited thereto in any manner.

<Example 1> Production of a Cr-1Al Alloy

Step 1: a melting temperature was set to 1600° C., and through a vacuum arc melting, an alloy having a composition including 1% by weight of aluminum, the balance of chromium and other unavoidable impurities was produced.

Step 2: the alloy undergone Step 1 was solution treated at 1100° C. for 20 minutes to produce a chromium-aluminum binary alloy.

<Example 2> Production of a Cr-2Al Alloy

In step 1 of Example 1, except that the amount of aluminum was changed to 2% by weight, a chromium-aluminum binary alloy was produced by performing the same procedure as Example 1.

<Example 3> Production of a Cr-4Al Alloy

In step 1 of Example 1, except that the amount of aluminum was changed to 4% by weight, a chromium-aluminum binary alloy was produced by performing the same procedure as Example 1.

<Example 4> Production of a Cr-6Al Alloy

In step 1 of Example 1, except that the amount of aluminum was changed to 6% by weight, a chromium-aluminum binary alloy was produced by performing the same procedure as Example 1.

<Example 5> Production of a Cr-10Al Alloy

In step 1 of Example 1, except that the amount of aluminum was changed to 10% by weight, a chromium-aluminum binary alloy was produced by performing the same procedure as Example 1.

<Example 6> Production of a Cr-15Al Alloy

In step 1 of Example 1, except that the amount of aluminum was changed to 15% by weight, a chromium-aluminum binary alloy was produced by performing the same procedure as Example 1.

<Example 7> Production of a Cr-20Al alloy

In step 1 of Example 1, except that the amount of aluminum was changed to 20% by weight, a chromium-aluminum binary alloy was produced by performing the same procedure as Example 1.

<Example 8> Production of a Cr-25Al alloy

In step 1 of Example 1, except that the amount of aluminum was changed to 25% by weight, a chromium-aluminum binary alloy was produced by performing the same procedure as Example 1.

<Example 9> Production of a Cr-30Al alloy

In step 1 of Example 1, except that the amount of aluminum was changed to 30% by weight, a chromium-aluminum binary alloy was produced by performing the same procedure as Example 1.

<Comparative Example 1> Pure Chromium

A commercial high purity chromium for a coating raw material (purity of 99.9% or more) was prepared as Comparative Example 1.

<Comparative Example 2> FeCrAl

A commercial FeCrAl alloy (product name: Kantal APMT) was prepared as Comparative Example 2. The alloy is composed of 21 wt % Cr, 5 wt % Al, 3 wt % Mo, and the balance of Fe.

<Comparative Example 3> Zircaloy-4

A commercial zircaloy-4 (product name: zircaloy-4) was prepared as Comparative Example 3. The alloy is composed of 1.5 wt % Sn, 0.2 wt % Fe, 0.1 wt % Cr, and the balance of Zr. In the figure, it is indicated as Z4.

<Experimental Example 1> Hardness Measurement

To investigate a mechanical property of the chromium-aluminum alloys produced in Examples 2, 3, 4, 6, and 9 and metal materials of Comparative Examples 1 to 3, hardness was measured in a condition of maintaining a load of 98 mN for 10 seconds at room temperature by a micro Vickers hardness tester and the result is shown in FIG. 1. At this time, the hardness value was measured 10 times for each sample and an average was taken.

As shown in FIG. 1, it can be seen that Example has a high hardness of about 260 to 410 Hv. On the other hand, the pure chromium in Comparative Example 1 had hardness of about 290 Hv, and the FeCrAl-alloy in Comparative Example 2 had hardness of about 260 Hv, and the zircaloy-4 in Comparative Example 3 had hardness of about 240 Hv, but it can be seen that hardness of these Comparative Examples does not exceed about 300 Hv.

As a result of observing indentation after the hardness measurement, since a hardness value was high, but a crack around the indentation was not observed in the alloys of Examples of the present invention, it was confirmed that there is no brittleness appearing in an oxide material and an intermetallic compound.

From these results, it can be seen that the hardness of the chromium-aluminum binary alloys according to the present invention is excellent compared to that of the metal materials of Comparative Examples. In addition, since the alloys of Examples of the present invention have higher hardness than zircaloy-4, the alloys of Examples of the present invention will have high wear resistance compared to zircaloy-4 when applied to a cladding tube.

<Experimental Example 2> Measurement of Oxidation Resistance Under Normal Operating Conditions To investigate high-temperature oxidation resistance of the chromium-aluminum alloys produced in Examples 1 to 9 and metal materials of Comparative Examples 1 to 3, the samples were prepared in 50 mm length, which were dipped in the solution composed of water:nitric acid:hydrofluoric acid(HF) at the ratio of 50:40:10 to eliminate impurities on the surface and any minute defect on the surface. The surface area and the primary weight of the surface-treated samples were measured before autoclaving. Then, the degree of corrosion was evaluated quantitatively by calculating the weight increase relative to the surface area by measuring the weight increase of the sample after corrosion for 120 days in 360° C. coolant. The results of the corrosion test are shown in FIG. 2.

Figure 2:
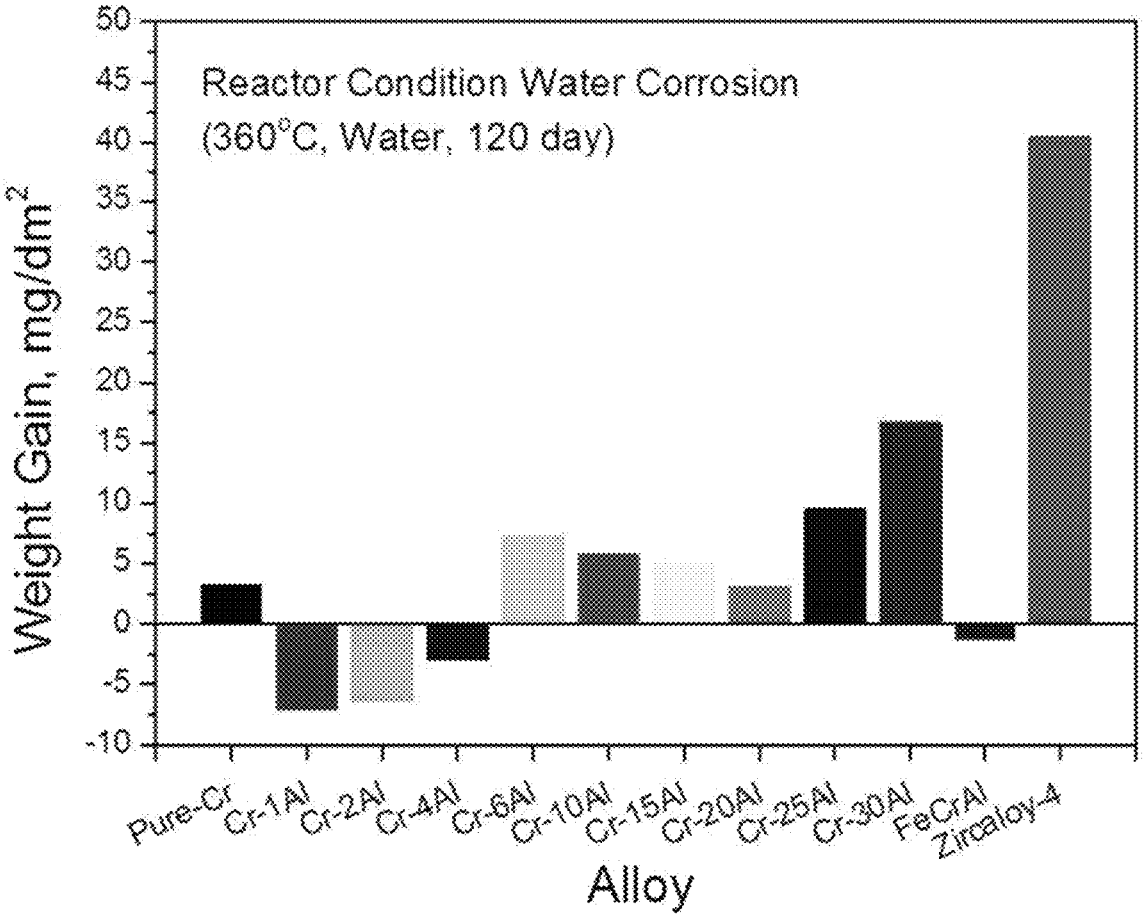
FIG. 2 shows the result after 120 days of the corrosion test simulating the normal operation condition of the nuclear power plant.

As shown in FIG. 2, when the amount of Al was included 6 to 30% by weight, particularly 6 to 20% by weight, corrosion resistance was excellent.

Figure 3:
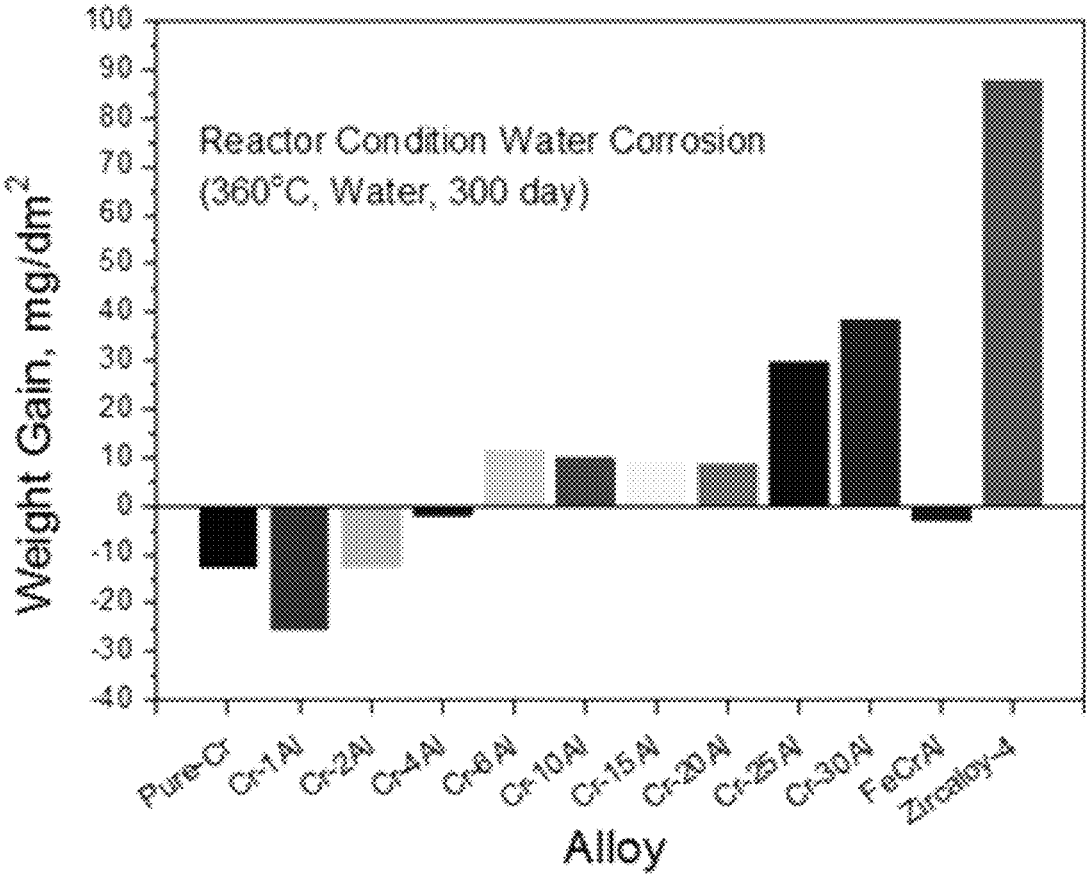
FIG. 3 shows the result after 300 days of the corrosion test simulating the normal operation condition of the nuclear power plant.

FIG. 3 shows the result of the experiment which was performed by the same manner as the above except that the corrosion was induced for 300 days. The result was consistent with the result shown in FIG. 2. The most important point in the normal corrosion in a nuclear power plant is that it must show the weight increasing behavior during the corrosion reaction. The decrease of the weight during the corrosion test indicates that corrosion product (oxide) could be separated off from the cladding tube or melted so that the concentration of impurities in the coolant is increased and at the same time the radiation contained in the impurities could contaminate the inside of the power plant.

Figure 6:
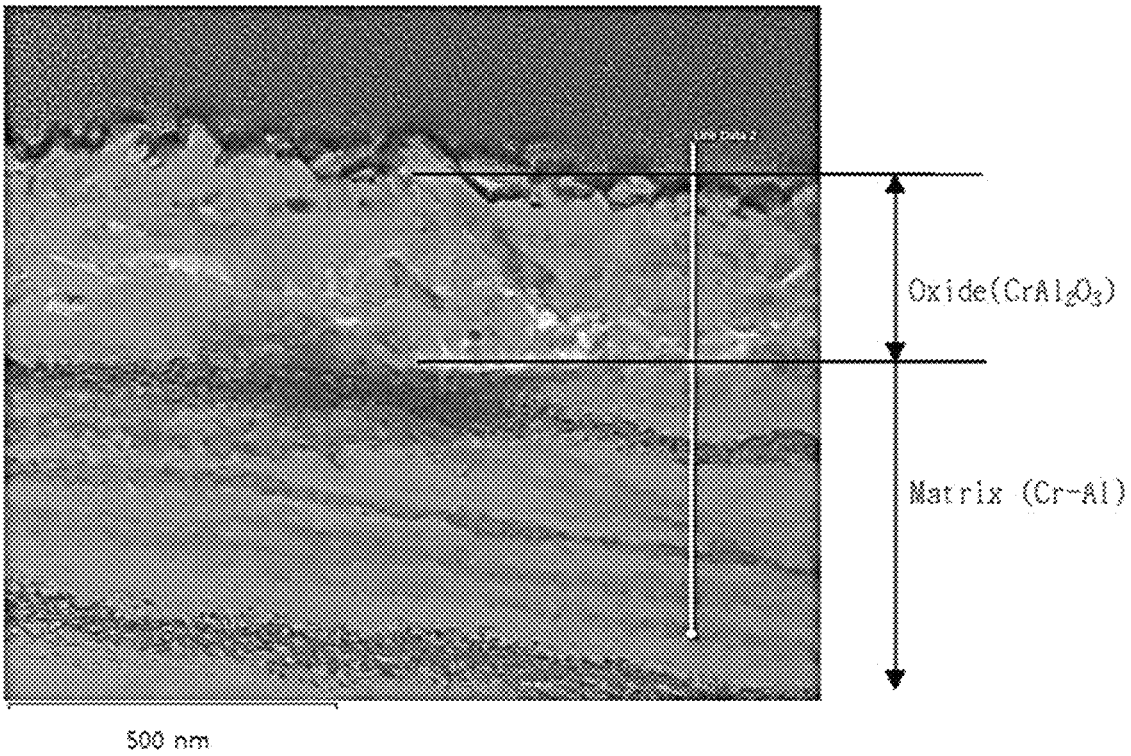
FIG. 6 shows photographs of cross-sections observed by a scanning electron microscope after 240 days in the corrosion test for the specimen of Example 5.

FIG. 6 shows the result of the observation of oxide film microstructure in the sample. As shown in FIG. 6, the sample was corroded for 240 days, followed by observation of the formed oxide film. The oxide was formed with the composition of $CrAl_2O_3$ and in the thickness of 300 nm, however it was not separated in two phases of $Cr_2O_3$ and $Al_2O_3$.

Figure 7:
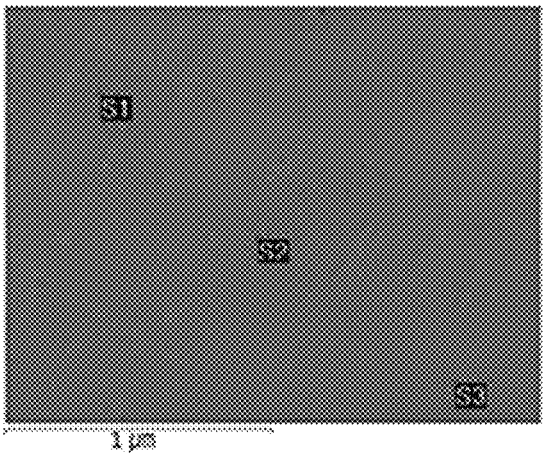
FIG. 7 shows photographs of cross-sections observed by a scanning electron microscope after 240 days in the corrosion test for the specimen of Example 7.
Figure 7:
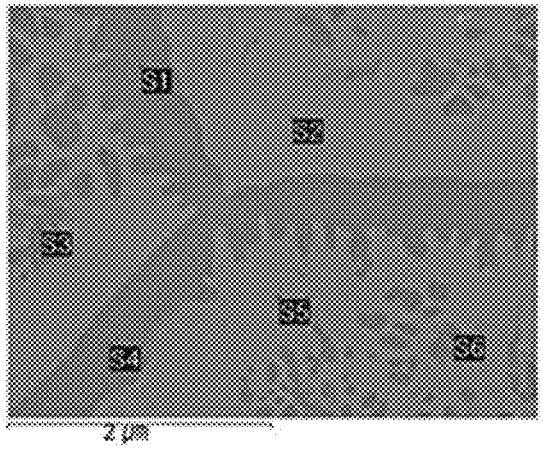

FIG. 7 shows the result of the investigation of phase changes of mother materials after 240 days of corrosion of the sample of Example 7 (Cr-20Al) and the sample of Example 9 (Cr-30Al).

As shown in Example 7, the composition was all the same in almost every point of observation, indicating that the phase change was not occurred.

However, as shown in Example 9, the intermetallic compound such as $AlCr_2$ was generated, and accordingly phase change was observed, precisely two different phases such as high Al content region (40 wt %) and low Al concentration region (25 w %) were observed. This phase change above seemed to result in the decrease of corrosion resistance.

<Experimental Example 3> High-Temperature Oxidation Resistance Measurement

Figure 4:
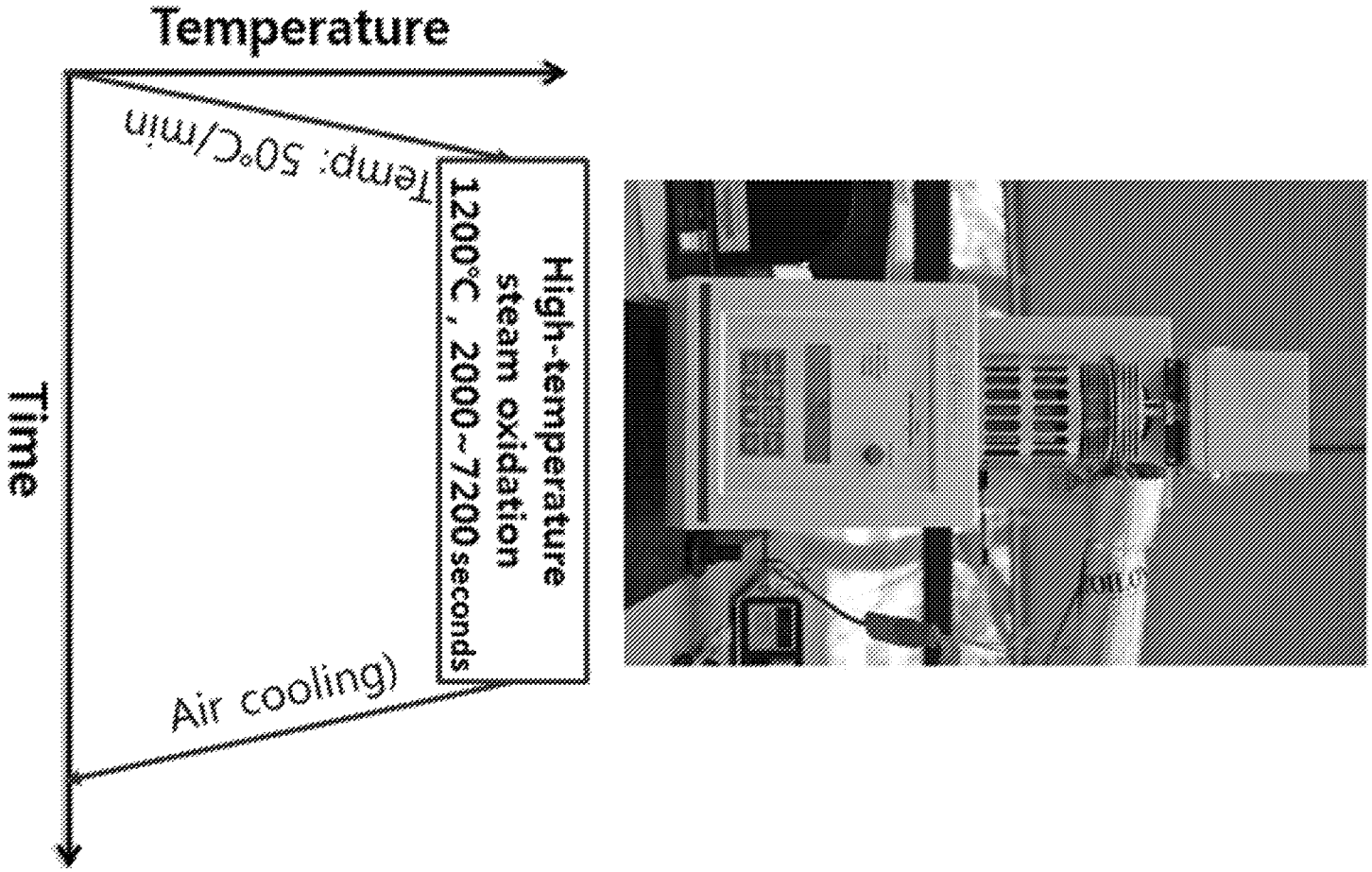
FIG. 4 shows a photograph of a high-temperature oxidation experiment apparatus and a schematic diagram of an experimental condition.
Figure 5:
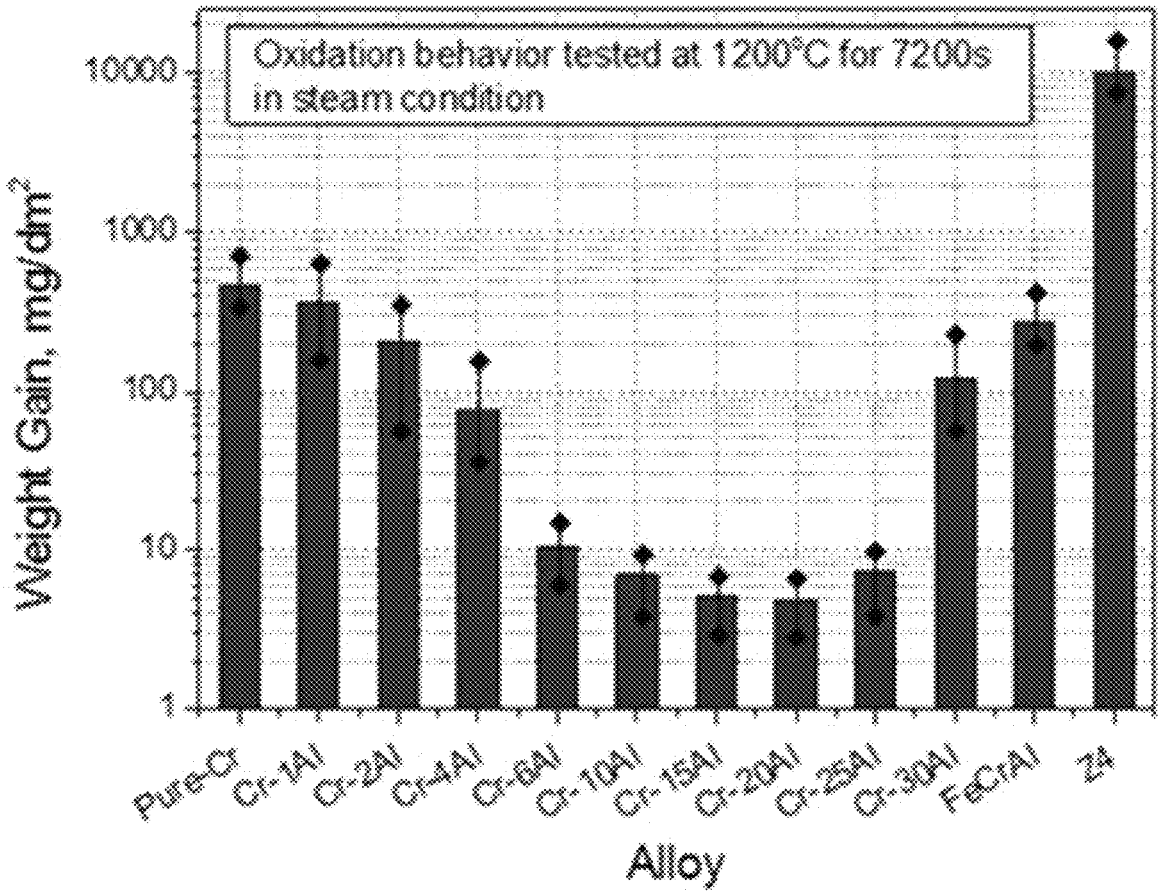
FIG. 5 is a graph showing an increase in weight of chromium-aluminum binary alloys produced in Examples 1 to 9 and metal materials of Comparative Examples 1 to 3 after a high-temperature oxidation experiment for 7200 seconds.

To investigate high-temperature oxidation resistance of the chromium-aluminum alloys produced in Examples 1 to 9 and metal materials of Comparative Examples 1 to 3, a temperature was raised to 1200° C. at a heating rate of 50° C./min and was maintained for 7200 seconds, and air-cooled to perform an experiment on high temperature steam oxidation with a thermogravimetric analyzer (TGA-51-SHIMADZU) shown in FIG. 4, and the result is shown in FIG. 5. In addition, after the experiment on the high temperature steam oxidation, cross-sections of Examples 1 to 9 were observed by a scanning electron microscope and the results are shown in FIG. 6.

As shown in FIG. 5, it can be seen that an oxidation amount of Examples 1 to 9 is significantly less than that of the zirconium alloy of Comparative Example 3.

According to the present invention, a chromium-aluminum binary alloy is easy to produce, has a high melting point of 1600° C. or more, and has ductility, thus being highly applicable to a material requiring high-temperature corrosion resistance and wear resistance, as a coating material. In addition, the chromium-aluminum binary alloy has excellent corrosion resistance in an accident-state of nuclear power as well as a steady-state operation, thus providing effects capable of significantly increasing economic feasibility and accident safety of nuclear power.

The chromium-aluminum binary alloy according to the present invention has high applicability as a coating material of a material which is easy to manufacture, has a high melting point of 1600° C. or more, has ductility, and is required to have high temperature corrosion resistance and abrasion resistance.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of producing a chromium-aluminum binary alloy with corrosion resistance, the method comprising:

Step 1—mixing and melting a raw material at a temperature of 1400° C. to 1800° C., said raw material comprising: 6 to 18% by weight of aluminum (Al), the balance of chromium (Cr), and other unavoidable impurities with respect to a total weight of the alloy; and Step 2—solution treating the alloy melted in Step 1 at a temperature of 950° C. to 1200° C.

2. The method according to claim 1, wherein the chromium-aluminum binary alloy has a hardness of 250-450 Hv.

3. The method of claim 1, wherein the raw material comprises 10 to 18% by weight of aluminum.

4. The method according to claim 1, wherein the chromium-aluminum binary alloy is used for a material for components of a nuclear plant, or structural material used in thermal power plant, air craft engine or a gas turbine.

5. The method according to claim 1, wherein the chromium-aluminum binary alloy is used for a surface coating material for a metal material.

6. The method of claim 1, wherein the solution treating of Step 2 is performed at a temperature of 1000° C. to 1200° C.

7. The method of claim 1, wherein the solution treating of Step 2 is performed at a temperature of 1050° C. to 1200° C.

* * * * *